US006417770B1

(12) United States Patent
Sturznickel

(10) Patent No.: US 6,417,770 B1
(45) Date of Patent: Jul. 9, 2002

(54) SECURITY SPACER MEMBER FOR A WINDOW

(76) Inventor: James F. Sturznickel, 2166 Mohler Dr., North Canton, OH (US) 44720

( * ) Notice: Subject to any disclaimer, the term of this patent is extended or adjusted under 35 U.S.C. 154(b) by 0 days.

(21) Appl. No.: 09/585,960

(22) Filed: Jun. 2, 2000

(51) Int. Cl.[7] ..... G08B 13/08

(52) U.S. Cl. ..... 340/547; 340/546; 340/545.1; 200/61.93

(58) Field of Search ..... 340/547, 539, 340/545.1, 546, 545.7, 545.8, 551; 116/86; 200/61.93

(56) References Cited

U.S. PATENT DOCUMENTS 4,553,134 A * 11/1985 Holt ..... 340/545
4,700,163 A * 10/1987 Wolfe, Jr. ..... 335/205
5,317,303 A * 5/1994 Ross et al. ..... 340/539
5,516,994 A * 5/1996 Lay ..... 200/61.93
5,576,678 A * 11/1996 Saunders ..... 340/545
5,610,581 A * 3/1997 Keller ..... 340/545
6,075,440 A * 6/2000 Carroll ..... 340/546

* cited by examiner

*Primary Examiner*—John Tweel
(74) *Attorney, Agent, or Firm*—Renner, Kenner, Greive, Bobak, Taylor & Weber

(57) ABSTRACT

A security spacer member (10) is provided for a security window (100) having a magnet (106) retained within its frame (104) and a magnet (110) retained within its sash (112) such that the two magnets (106, 110) mate upon closing of the security window (100) to maintain a security measure, such as an alarm, in a deactivated state. The security spacer member (10) has a shank portion (12) having first and second ends (14, 16) and one of the ends houses a magnet (30). In use, the security spacer member (10) is placed so as to prop open the security window (100), and the magnet (30) housed in the security spacer member (10) is positioned to mate with the magnet (106) in the frame (104) in order to maintain the security measure on its deactivated state despite the fact that the security window (100) is open.

6 Claims, 4 Drawing Sheets

SECURITY SPACER MEMBER FOR A WINDOW

TECHNICAL FIELD

The present invention relates generally to security windows and more particularly to a security spacer member for a window that holds the sash and window pane open while still serving to prevent and deter unauthorized entry into a home or office through a partially open window.

BACKGROUND ART

Many devices exist for preventing the unauthorized entry into an office, store, or home through a closed window. Of particular interest are those security window devices, known in the prior art, that operate an alarm or other security measure upon the activation of a circuit associated with the alarm or other security measure, wherein the circuit is opened or closed through the mating or disjoining of two magnetic components.

Referring now to FIG. 1, it can be seen that such a known security window system is designated by the numeral 100. Security window 100 provides a window frame 102 having a base 104 that houses a frame magnet 106. Frame magnet 106 is preferably sheathed in a casing 108 and is retained flush with the exposed horizontal surface area of base 104, such that the only material disposed between frame magnet 106 and the interior defined by frame 102 is casing 108. Frame magnet 106 and associated casing 108 are retained flush with the surface area of base 104 so that when the sash 112 is closed, frame magnet 106 will contactingly engage the window magnet 110 and associated casing 111 retained within the sash 112 surrounding the window pane 114.

Frame magnet 106 communicates with a circuit 116 which, as explained below, activates a security measure, such as an alarm, when an unauthorized entry is attempted through the security window 100. When sash 112 is closed and window magnet 110 and associated casing 111 contact or closely abut frame magnet 106 and associated casing 108, circuit 116 will not activate the security measure; however, when sash 112 is opened, such that window magnet 110 and frame magnet 106 are separated and no longer lie in close juxtaposition, circuit 116, through a Hall effect switch or other appropriate switch, activates the security measure in order to prevent or deter entry through security window 100.

Security systems employing these types of security windows also commonly provide an override switch whereby a security window may be opened and closed without activating the associated security measure so that the security windows may be opened and closed to air out or cool down a room. Of course, the security windows are essentially turned off in these situations, such that they no longer protect against the unauthorized intrusions for which they were installed. Thus, there exists a need in the art to provide an accessory for such security windows that allows these windows to be at least temporarily placed in an open position and yet still protect against an unauthorized entry through the window.

DISCLOSURE OF THE INVENTION

In light of the foregoing, it is an object of the present invention to provide a spacer member for a security window that allows the window to be placed in an open position while, at the same time, retaining the capability of signaling an unauthorized entry through the open window.

It is another object of the present invention to provide a spacer member which maintains continuity of the circuitry of such a security system when the window is in an open position.

It is an additional object of the present invention to provide a simple, inexpensive spacing member permitting a security window to be placed in an open position.

It is yet another object of the present invention to provide a spacer member that can be readily retrofitted to existing window configurations.

It is a further object to provide a spacer member that is relatively fool-proof in operation.

It is a further object to provide a spacer member that is adaptable to a variety of security systems.

In general, the foregoing and other aspects of the present invention are attained by a spacer member that is employed in combination with a security window having a frame magnet and a window magnet that are capable of contacting or abutting each other, the frame magnet communicating with a circuit that is capable of activating a security measure, such as an alarm, whereby the mating of the frame and window magnets insures that the security measure will not be activated by the circuit, while the disjoining of the magnets causes the security measure to be activated. The spacer member employed has a spacer portion with a first and a second end, the first end housing a magnet that can mate with the frame magnet to insure that the security measure is not activated and the second end serving to hold the sash and window pane of the security window in an open position.

PREFERRED EMBODIMENT FOR CARRYING OUT THE INVENTION

Figure 2:
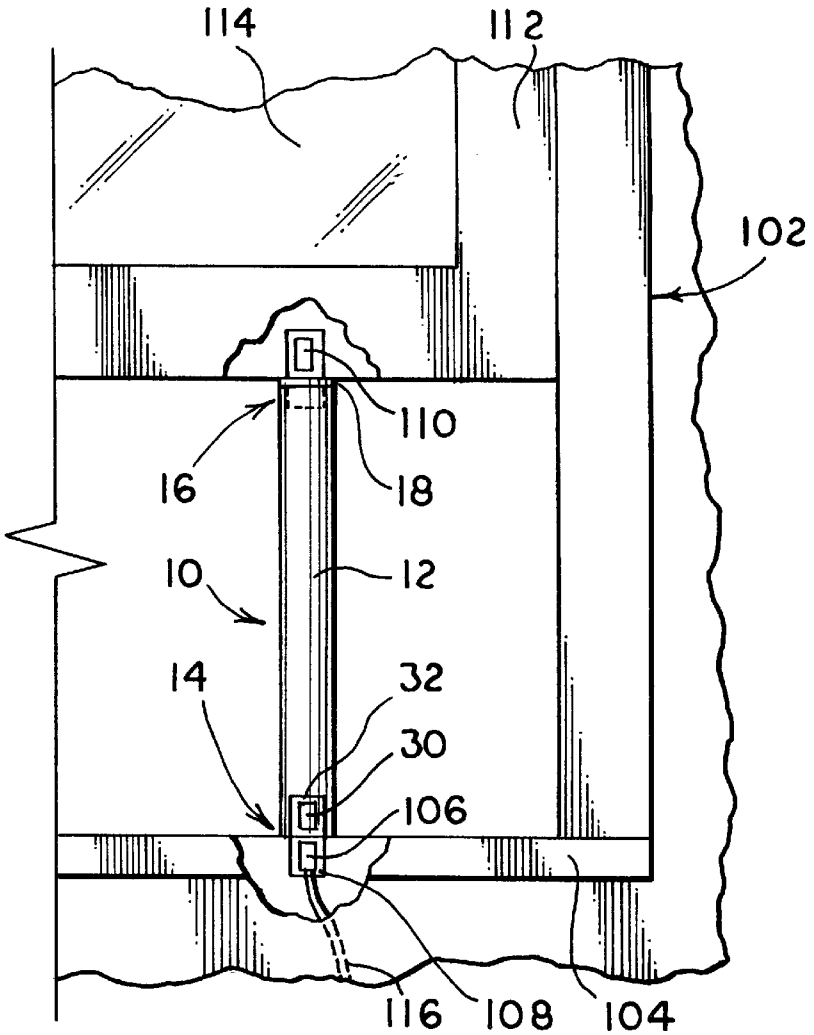
FIG. 2 is a cross-sectional view of a security window being propped open by a spacer member according to the concepts of the present invention.
Figure 1:
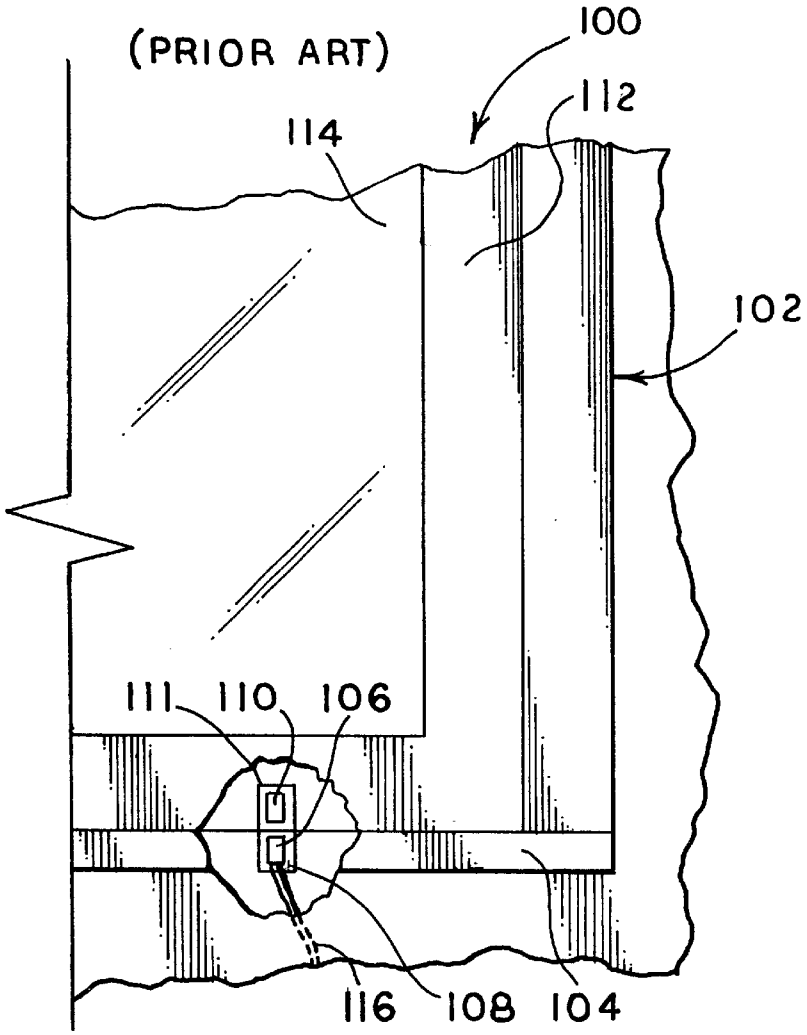
FIG. 1 is a cross-sectional view of an embodiment of a prior-art security window to which the present invention relates.
Figure 3:
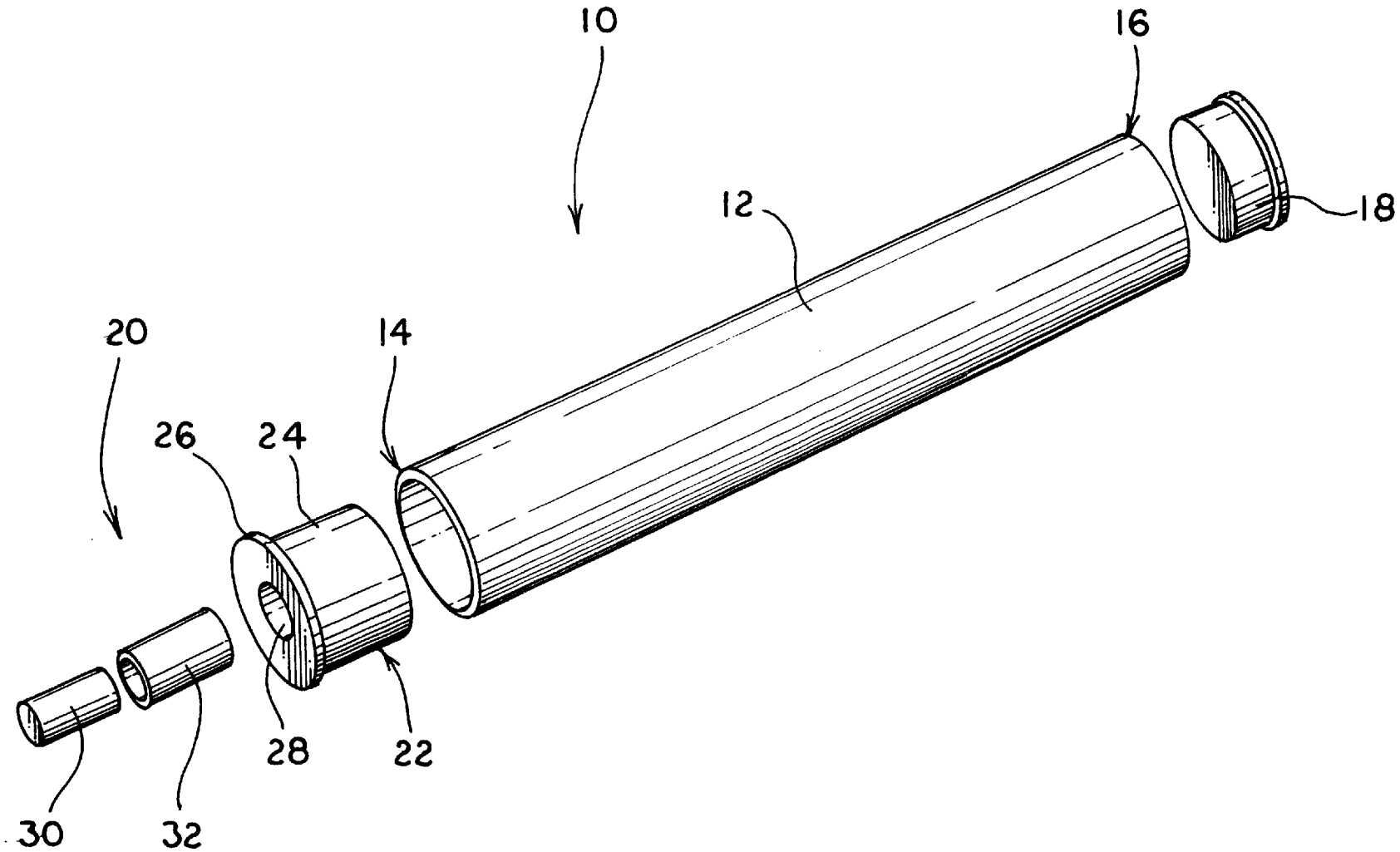
FIG. 3 is an enlarged, exploded assembly view of the spacer member of the present invention.

Referring now to FIGS. 2 and 3, the shank member of the present invention is generally designated by the numeral 10. Spacer member 10 includes a shank portion 12 having a first end 14 and a second end 16. In the interest of reducing material costs, shank portion 12 is preferably hollow; however, the majority of spacer portion 12 may be solid as long as at least one of the ends 14, 16 is capable of receiving a magnet, as will be herein described. If shank portion 12 is hollow, second end 16 may optionally be enclosed by a cap 18. As will become apparent hereinbelow, shank portion 12 is constructed from materials of sufficient rigidity to provide shank portion 12 with structural integrity sufficient to support at least the sprung weight of the sash and associated window pane of the security window with which spacer member 10 is to be employed. Preferably, as will become apparent hereinbelow, shank portion 12 is constructed from materials sufficient to support the entire weight of the sash and window pane so that spacer member 10 can be used on security windows in which the counterweights fail or are broken.

With particular reference to FIG. 3, it can be seen that first end 14 of shank portion 12 receives magnet assembly 20. Magnet assembly 20 consists of a housing 22 having an insert portion 24, a flange 26, and an aperture 28. Aperture 28 houses a magnet 30 and associated casing 32. Insert portion 24 is sized to be received in the hollow first end 14, while flange 26 abuts with the perimeter of first end 14, such that magnet assembly 20 is basically an inset cap on the first end 14 of shank portion 12. Aperture 28, in housing 22, is sized to receive magnet 30, which is optionally enclosed within magnet casing 32. Magnet 30 and associated casing 32 are removably received within aperture 26 by a friction fit or any other common means, as, for example, a threaded engagement. The removable engagement between magnet assembly 20 and shank portion 12, as well as that between magnet 30 with associated casing 32 and aperture 26, is advantageous because such an engagement provides a simple means by which magnet 30 may be replaced should its magnetism weaken or it otherwise becomes inoperative.

Figure 4:
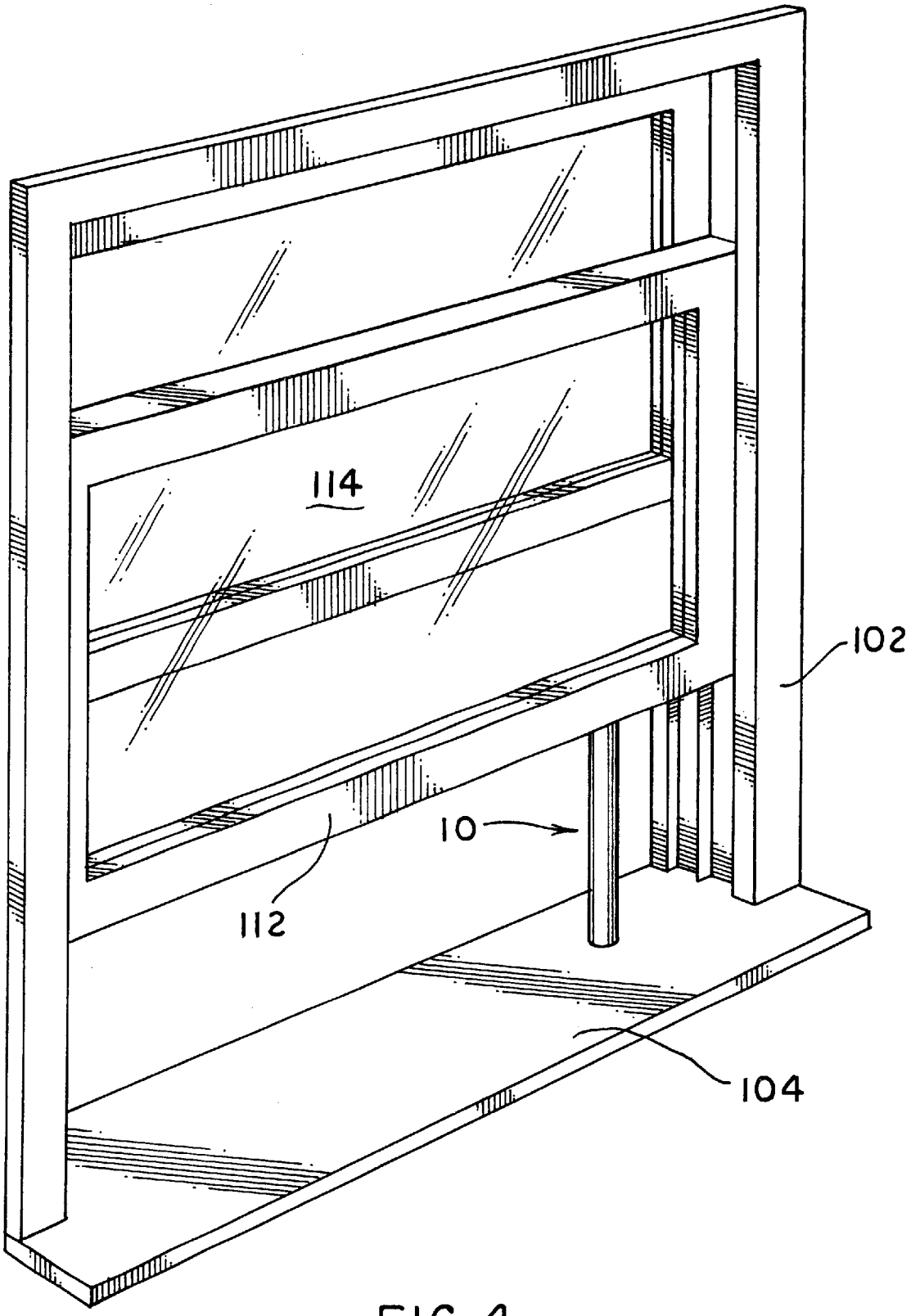
FIG. 4 is a perspective view of the security window of FIG. 1 employing the spacer member of the present invention to prop open the security window while maintaining the integrity of a security system.

In order to fully understand the utility of the spacer member 10 of the present invention, it is important to understand how the security window with which spacer member 10 is to be employed operates to detect and prevent unauthorized entry into a home, office, or store in which the security window is installed. Reference should therefore be made to the Background Art section of the present disclosure, as well as FIGS. 2 and 4. In these figures, it can be seen that spacer member 10 is placed between the base 104 of window frame 102 and sash 112 of the security window 100. The spacer member 10 is wedged between sash 112 and window frame 102 and is thereby held in position such that its magnet 30 is aligned and in engagement with the base magnet 106, which communicates with circuit 116. With spacer member 10 positioned in this manner, circuit 116 will not activate its associated security measure, even though the security window 100 is open. However, should someone attempt to enter through security window 100, the displacement of spacer member 10 will result in the activation of the security measure associated with circuit 116. Thus, employing spacer member 10 in combination with a security window 100 allows the sash 112 to be temporarily placed in an open position without frustrating the security function that security window 100 is to provide.

In order to install spacer member 10, security window 100 must first be deactivated so that the initial opening of the window and separation of window magnet 110 from frame magnet 106 does not cause the security measure to activate. Once the window is open, spacer member 10 can be placed between sash 112 and base 104, as discussed hereinabove. After spacer member 10 is positioned such that magnet 30 abuts frame magnet 106, security window 100 may be reactivated and, although security window 100 is open, the security measure will not be activated unless spacer member 10 is disturbed.

It should be noted that, inasmuch as it may be desired to open a security window 100 to different positions, shank portion 12 of spacer member 10 may vary considerably in length or a plurality of spacer member 10 may be employed to selectively position security window 100 in different open positions. Also, although all the Figs. have displayed a cylindrical spacer member 10, the shape is unimportant, and the present invention should not be limited thereto or thereby. It is also envisioned that shank portion 12 could be constructed to retract in length slightly in response to the weight of the sash 112 and window pane 114. Therefore, in an alternative embodiment, shank portion 12 could be constructed as two telescoping pieces that are longitudinally relatively positioned, one within the other, by means of a compression spring or other resilient material.

Figure 5:
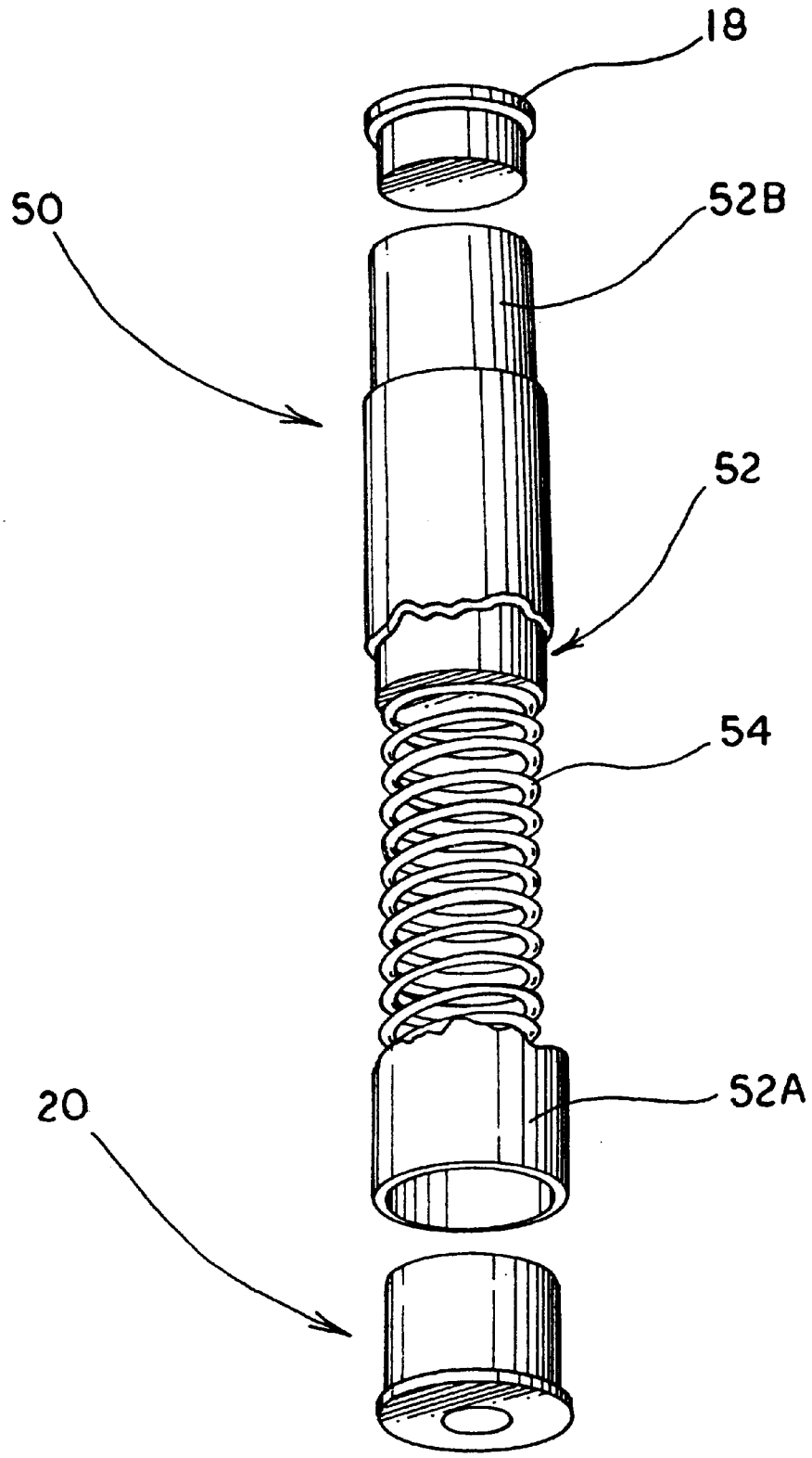
FIG. 5 depicts an alternative embodiment of the spacer member of the present invention.

Referring now to FIG. 5, such an alternative spacer member is generally designated by the numeral 50. Spacer member 50 has an alternative shank portion 52 that consists of two telescoping shanks 52A and 52B. Shanks 52A, 52B are sized such that shank 52B can fit at least partially within and slide longitudinally of shank 52A. A spring or other resilient member 54 serves to hold shanks 52A and 52B in their relative longitudinal positions and yet allows them to move relative to each other as shown by arrow S. This design provides a spacer member 50 that is capable of retracting in response to an extent of movement of window sash 112. Like spacer member 10, discussed hereinabove, alternative spacer member 50 also provides a magnet assembly 20 at one end thereof. In FIG. 5, magnet assembly 20 is shown as being received within shank 52A, although it should be readily apparent that magnet assembly 20 could be provided at either end of spacer member 50.

Thus, it should be evident that the spacer member for a security window disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

I claim:

1. A spacer member, in combination with a security window having a frame magnet and a window magnet capable of mating or abutting, the frame magnet communicating with a circuit that is capable of activating a security measure, whereby the mating of the frame and window magnets ensures that the security measure will not be activated by the circuit, while the disjoining of the magnet causes the security measure to be activated, said spacer member comprising:

a shank portion with a first end and a second end;

a spacer magnet retained within said first end, said magnet capable of mating with the frame magnet to ensure that the security measure is not activated, and said second end serving to wedgingly engage the security window whereby the security measure is activated upon attempted unauthorized entry by further raising the window or otherwise displacing the spacer member.

2. The combination of claim 1, wherein said spacer member further comprises:

a magnet assembly retained within said first end and removably receiving said spacer magnet.

3. The combination according to claim 2, wherein said magnet assembly comprises:

a housing having an insert portion for receipt in said first end of said spacer portion a flange for maintaining said magnet assembly at said first end, and an aperture for removably receiving said spacer magnet; and a casing associated with said spacer magnet.

4. The combination according to claim 1, wherein said shank portion is capable of responding to the weight of the sash and window pane of the security window.

5. The combination according to claim 4, wherein said shank portion comprises two telescoping portions.

6. The combination according to claim 5 wherein said shank portion comprises a first telescoping shank portion; a second telescoping shank portion fitting at least partially within said first telescoping shank portion; and a resilient member serving to hold said first and second telescoping shank portions in longitudinal relation and allowing said first and second telescoping shank portions to move relative to each other.

* * * * *